US005683508A

United States Patent [19]

Bleiler et al.

[11] Patent Number: 5,683,508

[45] Date of Patent: Nov. 4, 1997

[54] COATING APPARATUS AND METHOD FOR DISPENSING A LIQUID, AND DRAINING AND CLEANING A COATING APPARATUS

[75] Inventors: Dean K. Bleiler, Allentown; Edward B. Overly, Quakertown, both of Pa.

[73] Assignee: FIT Group, Inc., Quakertown, Pa.

[21] Appl. No.: 519,107

[22] Filed: Aug. 25, 1995

[51] Int. Cl.[6] ..... B05C 11/00

[52] U.S. Cl. ..... 118/46; 118/200; 118/663; 118/692; 118/712; 101/350; 101/366; 427/428; 239/127

[58] Field of Search ..... 118/46, 200, 712, 118/663, 692; 239/127; 101/350, 366; 427/428; 222/251

[56] References Cited

U.S. PATENT DOCUMENTS

| | | | |
|---|---|---|---|
| 3,974,768 | 8/1976 | Grobman | 101/366 |
| 4,527,479 | 7/1985 | Dahlgren et al. | 101/450.1 |
| 4,643,124 | 2/1987 | Switall | 118/259 |
| 4,737,378 | 4/1988 | Narita et al. | 118/663 |
| 4,822,647 | 4/1989 | Nozaki et al. | 118/692 |
| 5,005,478 | 4/1991 | Goldberg et al. | 101/425 |
| 5,010,817 | 4/1991 | Grosshauser | 101/350 |
| 5,054,392 | 10/1991 | Greenwood | 101/366 |
| 5,103,730 | 4/1992 | Sarda | 101/425 |
| 5,207,159 | 5/1993 | DeMoore et al. | 101/350 |
| 5,213,044 | 5/1993 | Elia et al. | 101/483 |
| 5,273,583 | 12/1993 | Langlois et al. | 118/712 |
| 5,330,576 | 7/1994 | Clauditz | 118/688 |
| 5,367,982 | 11/1994 | DeMoore et al. | 118/46 |
| 5,410,961 | 5/1995 | Denicola et al. | 101/363 |
| 5,425,809 | 6/1995 | Person | 118/46 |

FOREIGN PATENT DOCUMENTS

| | | |
|---|---|---|
| 60-196348 | 4/1985 | Japan . |
| 60-196348 | 4/1995 | Japan . |

*Primary Examiner*—Donald E. Czaja
*Assistant Examiner*—Michael P. Colaianni
*Attorney, Agent, or Firm*—Roberts & Mercanti, L.L.P.

[57] ABSTRACT

An improved coating apparatus which uniformly applies inks and other compositions onto substrates. The apparatus has the facility of an automated washing cycle for cleanup between different coating compositions. It includes an applicator for applying a liquid to a substrate; a supply pump which draw the liquid from a reservoir to the applicator means; a return pump which draw the liquid away from the applicator to a drain or back to the reservoir; and a flow controller which independently controls the pumping action of each of the supply pump and the return pump such that a return pumping force is maintained which is greater than an applied supply pumping force. The pumps and a series of three-port valves are automechanically adjusted to sequentially cause the apparatus to draw a liquid from a reservoir and direct the liquid to the applicator, drain the liquid from the apparatus, circulate a cleaning solution about the apparatus and drain the cleaning solution from the apparatus.

13 Claims, 3 Drawing Sheets

COATING APPARATUS AND METHOD FOR DISPENSING A LIQUID, AND DRAINING AND CLEANING A COATING APPARATUS

BACKGROUND OF THE INVENTION

1. Field of the Invention

The present invention relates to an apparatus for coating substrates. More particularly the invention pertains to an improved coating apparatus which uniformly applies inks and other compositions onto substrates. The apparatus has the facility of an automated washing cycle for cleanup between different coating compositions.

2. Description of the Prior Art

It is known in the art of flexographic printing to continuously apply inks or other coating compositions to paper or other substrates. In the usual case, ink is applied to the surface of an anilox roller through an ink fountain having doctor blades. Typical ink fountains are described in U.S. Pat. Nos. 5,410,961; 5,010,817, and 4,527,479 which are incorporated herein by reference. One problem with prior art fountains is that ink or other coating solutions may not be uniformly supplied to it. Typically, an ink is supplied to a fountain either by the action of gravity or a pump. Excess ink is likewise removed from a fountain either by gravity or a pump. Since various coating compositions have differing viscosities, it is advantageous to use a pump to supply and drain liquid to and from the fountain. In this regard, U.S. Pat. No. 5,213,044 shows a coating apparatus which uses a single pump which is capable of reversing fluid flow direction. U.S. Pat. No. 5,367,982 shows a circulation system for a fountain employing both fed and return line pumps. While the pumps adjust the flow rate of the liquid, the pumps are not independently variable. This is disadvantageous since pulsations and hence uneven flow can be caused in improperly adjusted flow lines. U.S. Pat. No. 4,643,124 shows another liquid coating supply system where the supply and return pumps act in unison by an air cylinder and are not independently controllable either in speed or magnitude of pumping strokes. This invention provides a coating system having supply and return pumps which are independently controllable in speed and/or magnitude of pumping strokes. This allows improved control of coating liquid flow as well as flow line pressure control for different viscosity liquids.

Another problem in the art is cleaning of the fountain and its supply and return lines. This invention therefore not only provides a system for circulating a liquid coating or ink through a fountain coater but also including means for automatically draining and washing the fountain and its liquid circulation system. When the fountain is to remain idle for an extended period, at the end of the work day, or between color changes the liquid must be drained from the fountain, and all fountain parts and flow lines must be thoroughly cleaned using appropriate solutions. Typically, the supply lines, return lines and the fountain must be flushed and hand cleaned. The coating rollers and reservoir pan must also be cleaned manually. A substantial amount of press downtime is involved during the manual cleaning of the coater components. Manual cleaning requires that the coater be removed from the press to provide clean-up access to internal components. In addition, the internal surfaces of the doctor blade cavity are difficult to reach, with the result that the reservoir cavity may become contaminated with a coating residue which builds up and may contaminate the coating liquid during subsequent press runs. The time spent in cleaning the coater is non-productive time and therefore there has been a need for a system to reduce the wash-up time between jobs. The above mentioned U.S. Pat. No. 5,367,982 shows one known cleaning system. As mentioned, this system is disadvantageous since the pumps are not independently variable as the application requires. The absence of liquid accumulators in this system does not provide for dampening of pressure surges.

The present invention provides an improved coating assembly which performs conventional coating operations, and which is automatically sequenced through cleaning cycles while the coater remains attached to the press, and does not require disassembly, removal and reassembly for manual cleaning. Cleaning operations are performed more completely and more thoroughly than can be achieved by conventional manual cleaning methods. The same pumps are used for circulating a cleaning solution as well as for circulating the coating liquid. The supply and return lines, valves and pumps which circulate the coating liquid and cleaning solution all are drained and cleaned simultaneously with the cleaning of the fountain and anilox roller, thus preventing the progressive build-up of contaminants which occur in the coating components of such systems. The valving, pumping and liquid supply reservoir and waste storage handle the circulation of both the coating liquid and the cleaning solution. The assembly employs three-port control valves to effect the different operating modes of coating, washing and draining which may be actuated automatically under the control of automatic sequencing means such as a programmable logic controller.

SUMMARY OF THE INVENTION

The invention provides a coating apparatus comprising:

a) applicator means capable of applying a liquid from a reserve on the applicator to a substrate;

b) supply pump means coupled in liquid flow communication with the applicator means, the supply pump means being capable of drawing the liquid from a reservoir and forcing the liquid to the applicator means;

c) return pump means coupled in liquid flow communication with the applicator means, the return pump means being capable of drawing the liquid from the applicator means and forcing the liquid to a drain; and d) flow controller means capable of independently controlling the pumping action of each of the supply pump means and the return pump means. In one embodiment of the invention, the supply pump means, return pump means and flow controller may be retrofit onto an existing applicator means. In another preferred embodiment the apparatus further comprises:

i) a first three-port valve having a first port connected to the reservoir, a second port connected to the supply pump means and a third port connected to a port of a second three-port valve;

ii) a second three-port valve having a first port connected to said first three-port valve, a second port connected to the reservoir and a third port connected to a port of a third three-port valve;

iii) a third three-port valve having a first port connected to a port of the second three-port valve, a second port connected to the drain and a third port connected to the return pump means;

iv) a fourth three-port valve having a first port connected to the return pump means, a second port connected to the return liquid accumulator and third port connected to an output of the supply pump means and an input of the supply liquid accumulator.

The invention also provides a method of dispensing a liquid to a substrate which comprises providing the above coating apparatus; causing the flow controller means to independently adjust each of the supply pump means and the return pump means such that a return pumping force is applied and maintained which is greater than an applied supply pumping force; and automechanically adjusting the first, second, third and fourth three-port valves to sequentially cause the apparatus to draw a liquid from a reservoir and direct the liquid to the applicator, drain the liquid from the apparatus, circulate a cleaning solution about the apparatus and drain the cleaning solution from the apparatus.

DETAILED DESCRIPTION OF THE PREFERRED EMBODIMENT

Figure 1:
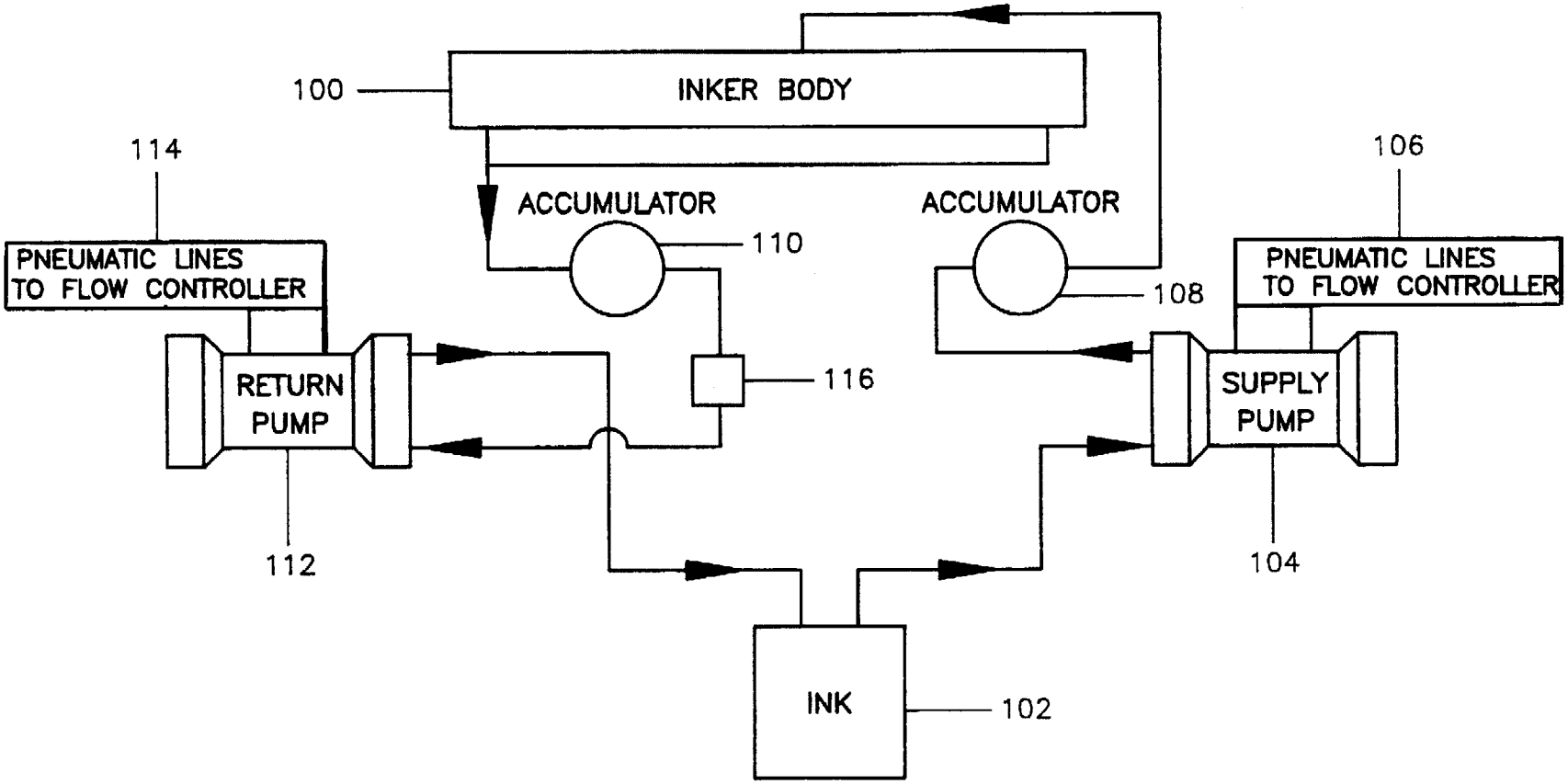
FIG. 1 shows a schematic representation of one embodiment of the coating apparatus arrangement according to the invention.

FIG. 1 schematically depicts one embodiment of the coating apparatus arrangement according to the invention. The coating apparatus of the invention employs applicator, fountain assembly or inker body means 100 capable of applying a liquid from a reserve on the applicator to a substrate. An applicator particularly useful for this invention is the fountain assembly which is described in U.S. Pat. No. 5,410,961. This fountain assembly is alternatively provided with an ink, a coating composition or a cleaning solution via supply lines to a manifold internal to the fountain. As shown in FIG. 1, ink from a reservoir 102 is connected via suitable tubing to a supply pump 104. The supply pump may be any suitable pumping means such as a gear pump, peristaltic pump, diaphragm pump or the like as are well known in the art. The pump action is preferably controlled in pumping magnitude and speed by a flow controller including a programmable logic controller, not shown, via pneumatic lines 106. The supply pump 104 pumps ink or other desired solution to a liquid accumulator 108 which may be in the form of a suitable liquid collection vessel. The accumulator serves to dampen liquid supply surges to the inker body and aids in the provision of a more uniform source of liquid to the inker body. As stated before, the inker body itself is well known in the art. An important feature of the invention is a liquid return arrangement which serves to provide a more uniform supply and pressure of liquid throughout the apparatus. Inker bodies comprise a liquid reserve. That is, several liters of a liquid, such as ink fill a chamber within the inker body. This chamber is continually refilled by the supply pump from the ink reservoir 102. In order to keep the liquid level in the inker body chamber as constant as possible, liquid is withdrawn from the inker body by a return system. Withdrawn liquid flows from the inker body 100 to a drain accumulator 110. Such liquid is drawn by a return pump 112 and excess ink returned to ink reservoir 102. Return pump 112 is likewise controlled by the flow controller, including the programmable logic controller, not shown, via pneumatic lines 114. An important feature of the invention is that the supply pump 104 and return pump 112 be operated such that the return pumping force applied and maintained is greater the applied supply pumping force. This assures that there is a negative pressure in the circulation tubing and other parts which prevents ink overflow in the inker body. Preferably the flow controller means, including appropriate pump motors, is capable of independently controlling the pumping speed and pumping force magnitude of the each of the supply pump means and the return pump means. An air check valve 116 is preferably positioned between the applicator and the return pump to prevent a vacuum from building-up in the return lines.

Figure 2:
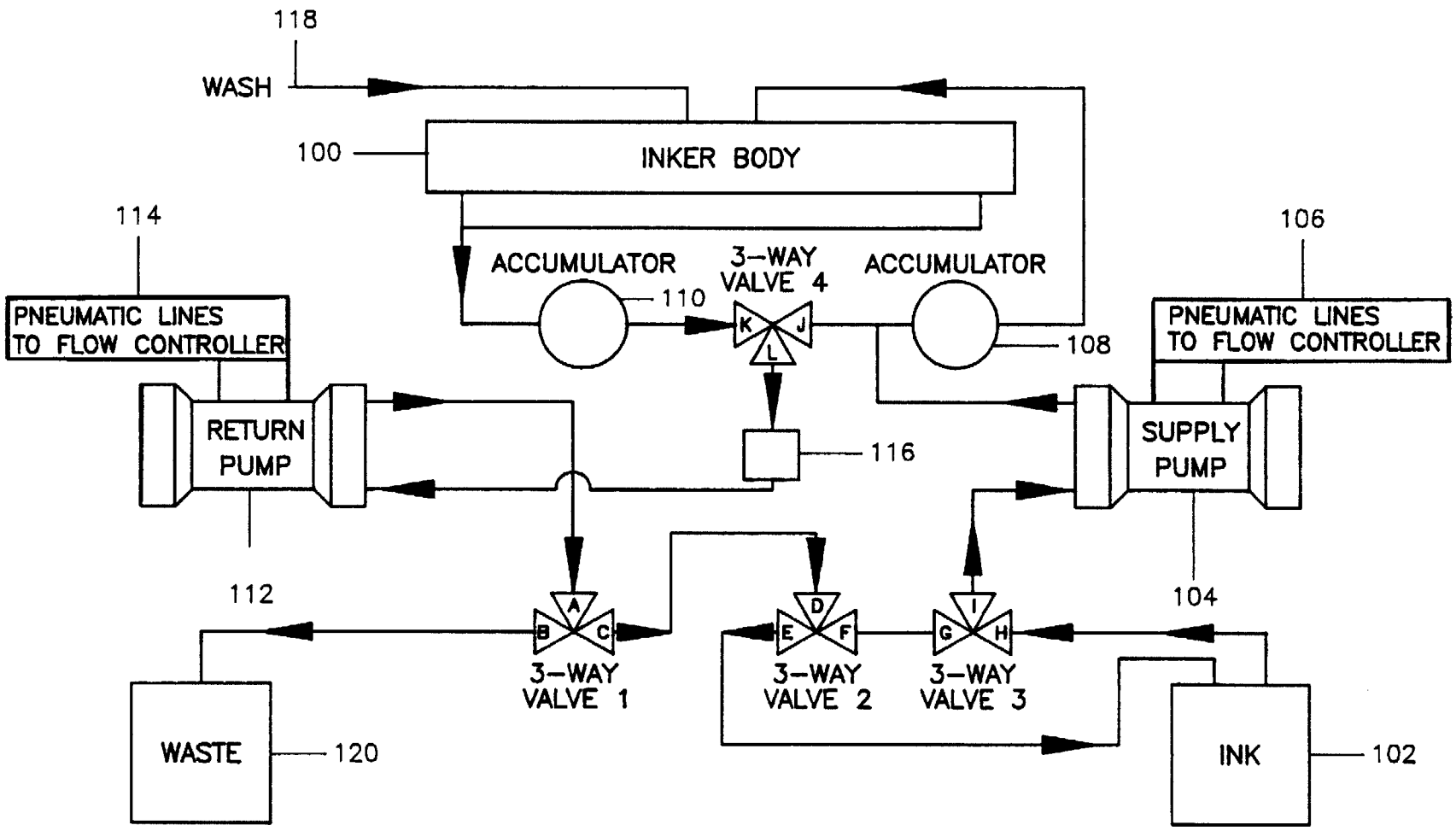
FIG. 2 shows a schematic representation of one embodiment of the coating apparatus arrangement according to the invention showing valve positions.

FIG. 2 shows another preferred embodiment of the invention including an arrangement of several three-port valves. As hereinbefore mentioned, it is necessary to clean the inker body and supply and return lines of the apparatus with some degree of frequency. During inking operations, ink is normally drawn from and returned to reservoir 102 by the supply and return pumps 104 and 112. However, during a liquid changeover, such as when it is desired to change ink colors, it is necessary first to drain all ink in the flow lines and then circulate and drain a cleaning solution prior to introducing the next liquid to be applied. This invention provides automechanically controlled alternate inking and washing cycles. By appropriately timing the function of each valve position, liquid supply and pump operation, ink is sequentially applied by the inker body, ink is drained from the overall apparatus, cleaning solution flushes the apparatus parts and is drained to waste, and finally a new ink supply is introduced.

FIG. 2 shows the positioning of the three-port valves. Such three port valves are well known in the art and widely commercially available. Three-port valve 3 has a first port connected to the reservoir 102, a second port connected to the supply pump means 104 and a third port connected to a port of three-port valve 2. Three-port valve 2 has a first port connected to three-port valve 1, a second port connected to the reservoir 102 and a third port connected to a port of three-port valve 3. Three-port valve 1 has a first port connected to a port of three-port valve 2, a second port connected to a waste drain 120 and a third port connected to the return pump 112. Three-port valve 4 has a first port connected to the return pump 112, a second port connected to the return liquid accumulator 110 and third port connected to an output of the supply pump 104 and an input of the supply liquid accumulator 108. During a washing cycle, cleaning solution enters the apparatus via line 118 and drains to waste collector 120. The cleaning solution may comprise water alone, a detergent or any other appropriate solvent. As more fully described in U.S. Pat. No. 5,410,961, the inker body preferably has washing nozzles which distribute the cleaning solution onto the applicator chamber, doctor blades, anilox rollers and other associated parts.

In FIG. 2 each of the ports of the four three-port valves are labelled A through K. Table 1 indicates the position of valves 1 through 4, supply and return pump action, cleaning solution supply and draining for a preferred automatic washing sequence. The operation of all of these parts and the timing of each step is preferably automatically configured and controlled by a programmable logic controller. The duration of each step lasts for from a few seconds to a few minutes depending on the nature of the liquid applied and the cleaning solution used. The duration of each step can be easily determined by those skilled in the art under the particular circumstances of operation.

TABLE 1

| Operation | Supply Pump | Return Pump | Valve 1 In/Out | Valve 2 In/Out | Valve 3 In/Out | Valve 4 In/Out | Water/Solvent Nozzles | Inker Drain Valves |
|---|---|---|---|---|---|---|---|---|
| Off | OFF | OFF | A/C | D/E | H/I | K/L | OFF | CLOSED |
| Ink On | ON | ON | A/B | D/E | H/I | K/L | OFF | OPEN |
| | ON | ON | A/C | D/E | H/I | K/L | OFF | OPEN |
| | ON | ON | A/C | D/E | H/I | K/L | OFF | CLOSED |
| Printing | ON | ON | A/C | D/E | H/I | K/L | OFF | CLOSED |
| Ink Off | OFF | ON | A/C | D/E | H/I | K/L | OFF | OPEN |
| Wash | OFF | ON | A/C | D/E | H/I | K/L | OFF | OPEN |
| | OFF | ON | A/B | D/E | H/I | K/L | ON | OPEN |
| | OFF | ON | A/C | D/E | H/I | J/L | INT | INT |
| | ON | ON | A/C | D/F | G/I | K/L | ON | OPEN |
| | INT | ON | A/B | D/F | G/I | J/L | INT | OPEN |
| | OFF | ON | A/B | D/F | G/I | K/L | ON | INT |
| | INT | ON | A/B | D/F | G/I | J/L | INT | OPEN |
| | OFF | ON | A/B | D/F | G/I | K/L | ON | INT |
| | INT | ON | A/B | D/F | G/I | J/L | INT | OPEN |
| | OFF | ON | A/B | D/F | G/I | K/L | ON | INT |

INT = Intermittent

In a typical inking sequence, the valve port positions are:

| | Valve 1 | Valve 2 | Valve 3 | Valve 4 |
|---|---|---|---|---|
| Open | A, C | D, E | H, I | K, L |
| Closed | B | F | G | J |

In a typical inking sequence, the pump speeds and drain valves are as follows:

| | Supply Pump Speed | Return Pump Speed | Drain Valves |
|---|---|---|---|
| Establish Ink Circuit | High | High | Open |
| Prime Inker | Low | Low | Closed |
| Print | Operator Choice | Determined By Supply Speed | Closed |

Automatic control and sequencing removes the burden of determining the length of the operating cycle from the press operator, and permits the press operator to attend to other duties during automatic wash and drain cycles. Thus, in automatic operation, all the press operator is required to do to initiate a cleaning cycle is to momentarily depress an actuator which causes the operation to advance from the printing mode to the drain mode, to the wash mode and finally turning off the pumps to a system off position upon conclusion of the cycles. The operator may then refill the reservoir with coating liquid, and restart the coating of operation. During the wash operation, cleaning solution is circulated through the applicator which cleans the anilox roller at the same time the applicator is cleaned.

Figure 3:
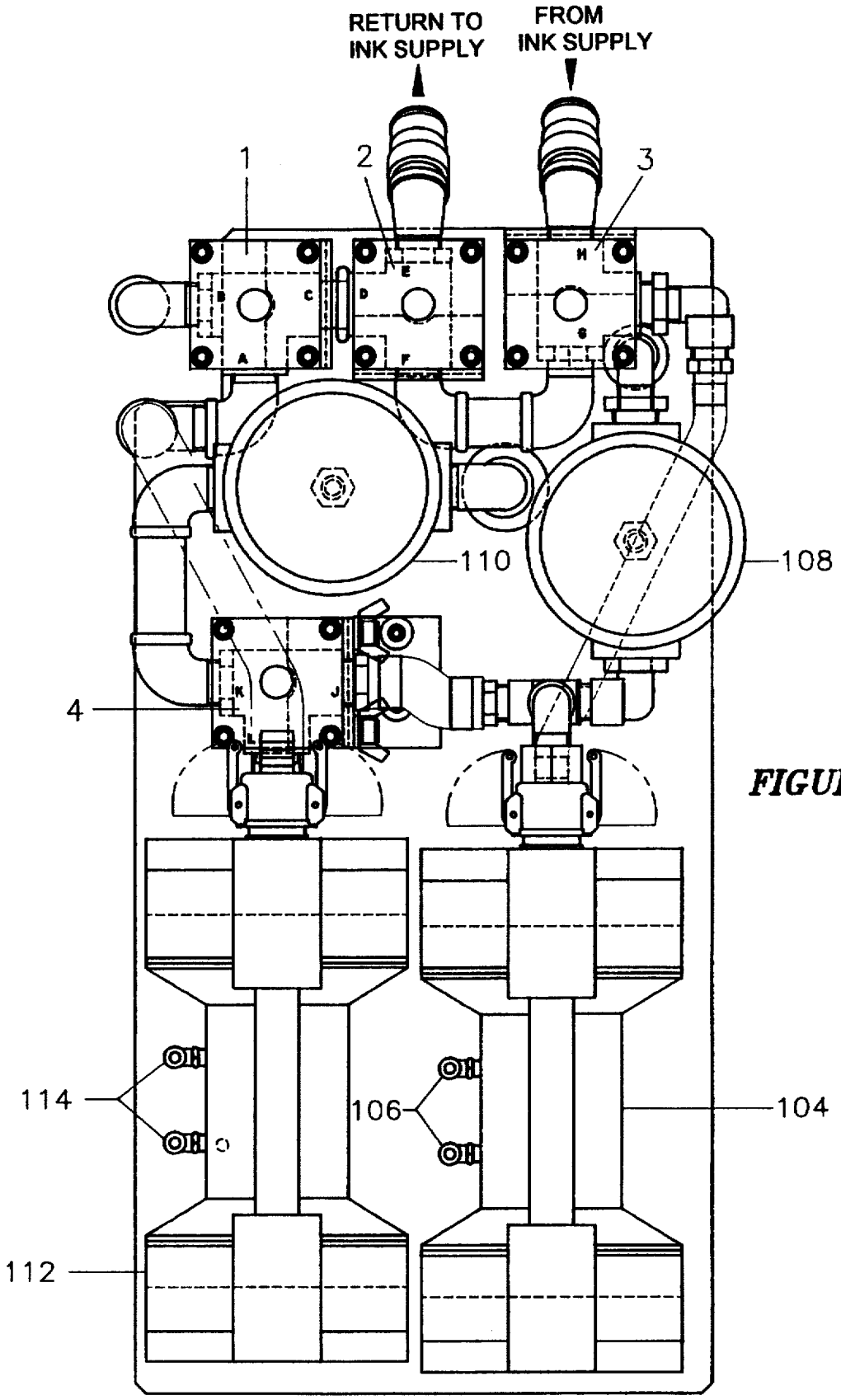
FIG. 3 shows a top view of an apparatus which embodies the invention.

FIG. 3 shows a top view of an apparatus which embodies the invention. Shown are supply and return pumps 104 and 112, pneumatic lines 106 and 114, accumulators 108 and 110, three-port valves 1, 2, 3, and 4, ink supply and return lines and suitable tubing and connectors.

It will be apparent that the coating circulation and wash-up system described above provides the advantages of the invention as stated. Regardless of whether the assembly is under remote control by manual or fully automatic, the requirement of removing the coater from the press for cleaning is completely eliminated. It will be appreciated that the coating circulation and wash-up system of the present invention may be retrofit onto existing coating equipment without modifying existing press or coater equipment. While a particular form of the present invention has been illustrated and described, it should be apparent that variations and modifications may be made therein without departing from the spirit and scope of the invention as set forth in the appended claims.

What is claimed is:

1. A coating apparatus comprising:

a) applicator means capable of applying a liquid from a reserve on the applicator means to a substrate;

b) supply pump means coupled in liquid flow communication with the applicator means, the supply pump means being capable of drawing the liquid from a reservoir and forcing the liquid to the applicator means; and c) return pump means coupled in liquid flow communication with the applicator means, the return pump means being capable of drawing the liquid from the applicator means and forcing the liquid to a drain; and d) flow controller means capable of independently controlling the pumping action of each of the supply pump means and the return pump means;

e) a supply liquid accumulator positioned between the supply pump means and the applicator means and a return liquid accumulator positioned between the applicator means and the return pump means;

f) a first three-port valve having a first port connected to the reservoir, a second port connected to the supply pump means and a third port connected to a port of a second three-port valve;

g) a second three-port valve having a first port connected to said first three-port valve, a second port connected to the reservoir and a third port connected to a port of a third three-port valve;

h) a third three-port valve having a first port connected to a port of the second three-port valve, a second port connected to the drain and a third port connected to the return pump means;

i) a fourth three-port valve having a first port connected to the return pump means, a second port connected to the return liquid accumulator and third port connected to an output of the supply pump means and an input of the supply liquid accumulator.

2. The coating apparatus of claim 1 wherein the flow controller means is capable of adjusting each of the supply pump means and the return pump means such that a return pumping force is applied and maintained which is greater than an applied supply pumping force.

3. The coating apparatus of claim 1 wherein the flow controller means is capable of independently controlling the pumping speed of the each of the supply pump means and the return pump means.

4. The coating apparatus of claim 1 wherein the flow controller means is capable of independently controlling the magnitude of pumping force of each of the supply pump means and the return pump means.

5. The coating apparatus of claim 1 wherein the flow controller means maintains an adjustment of each of the supply pump means and the return pump means such that a return pumping force is applied and maintained which is greater than an applied supply pumping force, and the supply pump means applies a pumping force of liquid toward the applicator means at the same time that the return pump means applies a pumping force of liquid away from the applicator means.

6. The coating apparatus of claim 1 wherein the flow controller means comprises a programmable logic controller.

7. The coating apparatus of claim 1 further comprising an air check valve positioned between the applicator means and the return pump means.

8. The coating apparatus of claim 1 wherein each of the supply pump means and the return pump means independently comprise a gear pump, peristaltic pump or diaphragm pump.

9. An apparatus for supplying a liquid to a coating applicator means which is capable of applying the liquid to a substrate, which apparatus comprises:

a) supply pump means coupled in liquid flow communication with the applicator means, the supply pump means being capable of drawing the liquid from a reservoir and forcing the liquid to the applicator means; and b) return pump means coupled in liquid flow communication with the applicator means, the return pump means being capable of drawing the liquid from the applicator means and forcing the liquid to a drain; and c) flow controller means capable of independently controlling the pumping action of each of the supply pump means and the return pump means;

d) a supply liquid accumulator positioned between the supply pump means and the applicator means and a return liquid accumulator positioned between the applicator means and the return pump means;

e) a first three-port valve having a first port connected to the reservoir, a second port connected to the supply pump means and a third port connected to a port of a second three-port valve;

f) a second three-port valve having a first port connected to said first three-port valve, a second port connected to the reservoir and a third port connected to a port of a third three-port valve;

g) a third three-port valve having a first port connected to a port of the second three-port valve, a second port connected to the drain and a third port connected to the return pump means;

h) a fourth three-port valve having a first port connected to the return pump means, a second port connected to the return liquid accumulator and third port connected to an output of the supply pump means and an input of the supply liquid accumulator.

10. A method of dispensing a liquid to a substrate which comprises:

I) providing a coating apparatus comprising:

a) applicator means capable of applying a liquid from a reserve on the applicator means to a substrate;

b) supply pump means coupled in liquid flow communication with the applicator means, the supply pump means being capable of drawing the liquid from a reservoir and forcing the liquid to the applicator means; and c) return pump means coupled in liquid flow communication with the applicator means, the return pump means being capable of drawing the liquid from the applicator means and forcing the liquid to a drain; and d) flow controller means capable of independently controlling the pumping action of each of the supply pump means and the return pump means;

e) a supply liquid accumulator positioned between the supply pump means and the applicator means and a return liquid accumulator positioned between the applicator means and the return pump means;

f) a first three-port valve having a first port connected to the reservoir, a second port connected to the supply pump means and a third port connected to a port of a second three-port valve;

g) a second three-port valve having a first port connected to said first three-port valve, a second port connected to the reservoir and a third port connected to a port of a third three-port valve;

h) a third three-port valve having a first port connected to a port of the second three-port valve, a second port connected to the drain and a third port connected to the return pump means;

i) a fourth three-port valve having a first port connected to the return pump means, a second port connected to the return liquid accumulator and third port connected to an output of the supply pump means and an input of the supply liquid accumulator, II) causing the flow controller means to independently adjust each of the supply pump means and the return pump means such that a return pumping force is applied and maintained which is greater than an applied supply pumping force.

11. A method of dispensing a liquid to a substrate which comprises:

I) providing a coating apparatus comprising:

a) applicator means capable of applying a liquid from a reserve on the applicator means to a substrate;

b) supply pump means coupled in liquid flow communication with the applicator means, the supply pump means being capable of drawing the liquid from a reservoir and forcing the liquid to the applicator means; and c) return pump means coupled in liquid flow communication with the applicator means, the return pump means being capable of drawing the liquid from the applicator means and forcing the liquid to a drain; and d) flow controller means capable of independently controlling the pumping action of each of the supply pump means and the return pump means;

e) a supply liquid accumulator positioned between the supply pump means and the applicator means and a return liquid accumulator positioned between the applicator means and the return pump means;

f) a first three-port valve having a first port connected to the reservoir, a second port connected to the supply pump means and a third port connected to a port of a second three-port valve;

g) a second three-port valve having a first port connected to said first three-port valve, a second port connected to the reservoir and a third port connected to a port of a third three-port valve;

h) a third three-port valve having a first port connected to a port of the second three-port valve, a second port connected to the drain and a third port connected to the return pump means;

i) a fourth three-port valve having a first port connected to the return pump means, a second port connected to the return liquid accumulator and third port connected to an output of the supply pump means and an input of the supply liquid accumulator;

II) causing the flow controller means to independently adjust each of the supply pump means and the return pump means such that a return pumping force is applied and maintained which is greater than an applied supply pumping force; and III) automechanically adjusting the first, second, third and fourth three-port valves to sequentially cause the apparatus to draw a liquid from a reservoir and direct the liquid to the applicator means, drain the liquid from the apparatus, circulate a cleaning solution about the apparatus and drain the cleaning solution from the apparatus.

12. The method of claim 11 wherein the flow controller means maintains an adjustment of each of the supply pump means and the return pump means such that a return pumping force is applied and maintained which is greater than an applied supply pumping force, and the supply pump means applies a pumping force of liquid toward the applicator means at the same time that the return pump means applies a pumping force of liquid away from the applicator means.

13. The method of claim 11 wherein the flow controller adjustment and first, second, third and fourth three-port valves adjustment is controlled by a programmable logic controller.

* * * * *